US007905422B2

(12) United States Patent
Vast et al.

(10) Patent No.: US 7,905,422 B2
(45) Date of Patent: Mar. 15, 2011

(54) RELATIVELY SMALL SECURITY ELEMENTS, PRODUCTION METHOD THEREOF, SHEET AND SECURITY DOCUMENT COMPRISING SAME

(75) Inventors: Nathalie Vast, Mont Saint Eloi (FR); Pierre Doublet, Saint-Brice (FR)

(73) Assignee: Arjowiggins Security, Paris (FR)

( * ) Notice: Subject to any disclaimer, the term of this patent is extended or adjusted under 35 U.S.C. 154(b) by 1119 days.

(21) Appl. No.: 10/589,002

(22) PCT Filed: Feb. 11, 2005

(86) PCT No.: PCT/FR2005/000337

§ 371 (c)(1),
(2), (4) Date: Aug. 10, 2006

(87) PCT Pub. No.: WO2005/078192

PCT Pub. Date: Aug. 25, 2005

(65) Prior Publication Data

US 2007/0090196 A1 Apr. 26, 2007

(30) Foreign Application Priority Data

Feb. 11, 2004 (FR) ..... 04 01330

(51) Int. Cl.
*G06K 19/06* (2006.01)

(52) U.S. Cl. ..... 235/494; 235/380; 235/491; 235/492

(58) Field of Classification Search ..... 235/380, 235/491, 492, 494
See application file for complete search history.

(56) References Cited

U.S. PATENT DOCUMENTS

| | | | | | |
|---|---|---|---|---|---|
| 4,892,336 | A | * | 1/1990 | Kaule et al. | 283/91 |
| 4,897,300 | A | * | 1/1990 | Boehm | 428/195.1 |
| 4,943,093 | A | * | 7/1990 | Melling et al. | 283/83 |
| 5,697,649 | A | * | 12/1997 | Dames et al. | 283/83 |

FOREIGN PATENT DOCUMENTS

| | | | |
|---|---|---|---|
| CN | 1 157 790 | A | 8/1997 |
| EP | 0 342 929 | A | 11/1989 |
| EP | 0 518 740 | A | 12/1992 |
| FR | 1 413 910 | A | 9/1965 |
| FR | 2 593 840 | A | 8/1987 |
| JP | 2001-159096 | A | 6/2001 |
| WO | WO 96/35586 | A | 11/1996 |
| WO | WO 99/45200 | A | 9/1999 |
| WO | WO 2004/025028 | A | 3/2004 |

OTHER PUBLICATIONS

Database WPI, Section PQ, Week 200140, Derwent Publications Ltd., AN 2001-375329 XP002296844.
Patent Abstract of Japan, vol. 2000, No. 23, Feb. 10, 2001.
International Search Report of PCT/FR2005/000337, date of mailing Jun. 29, 2005.

* cited by examiner

*Primary Examiner* — Michael G Lee
*Assistant Examiner* — Kristy A Haupt
(74) *Attorney, Agent, or Firm* — Westerman, Hattori, Daniels & Adrian, LLP

(57) ABSTRACT

The invention relates to a flat security element, having a front side and a reverse side, and being relatively small in size, such as planchettes, including, at least on one of its sides, at least one in-register authentication pattern and/or an authentication pattern resulting from the combination and/or superposition of a pattern on its front side and of a pattern on its reverse side, at least one of said authentication patterns being at least partly observable in transmitted light. It also relates to the manufacturing process thereof and to the security sheets and documents containing them.

27 Claims, No Drawings

RELATIVELY SMALL SECURITY ELEMENTS, PRODUCTION METHOD THEREOF, SHEET AND SECURITY DOCUMENT COMPRISING SAME

The invention relates to flat security elements of relatively small size, of the planchette type, and also to security documents comprising these elements and to the process for manufacturing said elements.

In security documents there are small security elements referred to as planchettes, making it possible to authenticate the documents. The planchettes are similar to confetti of various shapes, for example circular or hexagonal. It is advantageous for these planchettes, and therefore the material from which they are cut, to have optical surface effects, such as iridescence or dichroism and/or luminescence, and in particular fluorescence, reflection or polarization of the light. These effects are obtained for example by printing with or inclusion of specific compounds. Moreover, these planchettes may include authentication agents.

These planchettes are generally made by cutting them from a plastic sheet or film or from a sheet of paper or complex, by a sequential stamping operation on a flat sheet using punches or barbs. These planchettes have a size of around 1.5 mm. The sheets are plastic sheets and/or paper sheets of low basis weight. When they are based on a sheet of paper, this may be what is called an overlay sheet, usually employed as a protective sheet in the field of decorative laminated papers. This sheet is conventionally manufactured by the drainage of an aqueous suspension of cellulose fibers refined to a low degree, about 20° SR (degrees Schoepper-Riegler), and containing a wet-strength agent, said sheet being nonopacified and having a low basis weight, of around 25-40 g/m$^2$, and a thickness of between 50 and 100 μm. The sheets may include an agent for improving their wettability and/or a heat-sealing lacquer facilitating their retention in the paper. Other types of papers may be used. Each planchette is in general in a single color.

To manufacture security papers or papers for banknotes that include planchettes, the planchettes are introduced into the aqueous dispersion containing cellulose fibers, possibly synthetic fibers, and other additives commonly employed in papermaking. When the aqueous suspension is drained on a wire of a paper machine, whether a cylinder mold or a Fourdrinier machine, a certain number of planchettes are located on the surface of the paper sheet thus formed, the sheet then being dried.

Security documents containing planchettes are for example described in the patents EP 342 929, EP 546 917, EP 544 611 and U.S. Pat. No. 4,037,007.

It is also known to introduce luminescent, in particular fluorescent, security fibers, which are therefore also visible in UV light, of different colors, into security documents, especially banknote papers. These fibers are small plastic cylinders usually obtained by extrusion. One drawback of these conventional cylindrical security fibers is that they may create areas of greater thickness or may cause problems when printing the document if they are too coarse.

In the field of security documents, the aim is permanently to improve their level of security.

The Applicant therefore proposes security elements which have a level of security and security options that are greater than those existing hitherto and which can be introduced into documents, especially during the manufacture of the substrate.

For this purpose, the invention provides flat security elements having one or more patterns or means of authentication and being relatively small in size, so that they can be easily introduced during manufacture of the substrate of the security document.

The invention therefore relates to a flat security element, having a front side and a reverse side, and being relatively small in size, such as planchettes, which is characterized in that it includes, at least on one of its sides, at least one in-register authentication pattern and/or an authentication pattern resulting from the combination and/or superposition of a pattern on its front side and of a pattern on its reverse side, at least one of said authentication patterns being at least partly observable in transmitted light.

Said element therefore includes an authentication pattern observable in transmitted light, which may be the in-register pattern and/or a pattern resulting from the combination and/or superposition of the patterns on the front and reverse sides. The patterns on the front and reverse sides may be in-register patterns and/or may also have an authentication pattern function.

According to one particular embodiment of the invention, said in-register authentication pattern is in register either with respect to at least one portion of the shape of said security element or with respect to at least one portion of said patterns. It may consist of a combination of colors in mutual register. For example, a pattern may represent the image of the flag of a country, of lines of different colors.

Preferably, at least one of the patterns (the in-register pattern, the front side pattern, the reverse side pattern or the pattern resulting from the front and reverse side patterns) is visible to the naked eye, that is to say without using a magnifier. However, this observation with the naked eye may require the use of a device for revealing the pattern, such as a source of UV radiation if the pattern is fluorescent or phosphorescent, or a source of infrared radiation if the pattern is sensitive to this type of radiation.

According to one particular embodiment of the invention, said security element includes, as pattern on the front side, at least one given color and as pattern on the reverse side at least one other given color, said authentication pattern observable in transmitted light being the color resulting from the color on the reverse side and the color on the front side. The colors on the front and reverse sides may also each have an authentication role.

Preferably, the colors on the front and reverse sides are chosen from primary colors.

According to another particular embodiment of the invention, said security element is such that at least one of said patterns is a pattern in the form of a geometric pattern, in particular in alphanumeric form, and/or in the form of a grid and/or lines and/or dots. In this embodiment, said pattern observed in transmitted light may result from the combination and/or juxtaposition of the patterns present on the front and reverse sides of said element.

Preferably, the security element according to the invention is such that its dimensions are between 0.5 and 6 mm, preferably between 1 and 4 mm.

These security elements may be of any possible geometric shapes. In particular, they may be square, rectangular, triangular, circular or oval shapes, or in the shape of a star, a moon or a shape having curved edges, for example of the sinusoidal type.

According to one particular embodiment of the invention, the security element includes printing in an amount of 1 to 10 g/m$^2$ per side, preferably between about 2 and 5 g/m$^2$ per side, by dry weight.

More particularly, the security element includes patterns chosen from those that are visible in natural light or visible in UV light, that are luminescent, particularly fluorescent or phosphorescent, that are detectable by near or medium infrared radiation, that are thermochromic or piezochromic, that are based on DNA traces, that are optically variable, especially iridescent, or based on liquid crystals or on diffraction gratings or on moirépatterns or holograms, or that are electromagnetic, or combinations thereof In particular, said security element according to the invention includes, beneath or alongside said patterns, printing of electromagnetic, especially magnetic, character and, in particular, continuous tracks or codes in the form of magnetic bits.

According to one particular embodiment of the invention, the security element includes chemical authentication reactants, or reactants that reveal a specific event.

The security element according to the invention has, as medium, a sheet of paper or of nonwoven, a plastic film or a complex of these materials.

According to one particular embodiment, said element is based on a medium having a low basis weight, especially 25-40 g/m$^2$, and/or a thickness of about 50 to 100 μm.

More particularly, said medium is a paper based on cellulose fibers refined to a low degree, of the overlay type.

According to another particular embodiment, the plastic film of said element is a polyester film.

According to one particular embodiment of the invention, said element is based on a bulk-opacified medium or on a medium having, on at least one of its sides, at least partly, a full or partial color, opacifying or barrier layer or printing. The opacification/barrier makes it possible to suppress, if this is desired, the interpenetration or interference of the printing produced on the front and reverse sides in reflected light. This is because, in the case of thin porous mediums such as thin overlay paper, the inks penetrate into the paper and partly migrate from one side to the other and therefore interfere with one another. This is not necessarily desirable or, in the case of mediums that are of low opacity or even transparent, the effects may interfere with one another. However, a certain level of transparency may be maintained if it is desired to have an observable effect in transmitted light. In one particular case, the opacification may be achieved only partially on the element and thus it is possible to have an element with one portion with no observable effect in transmitted light and one portion with an effect observable in transmitted light.

The invention also relates to a security sheet comprising a fibrous substrate that includes several flat security elements, having a front side and a reverse side, and being relatively small in size, such as a planchette, said element being as described above. For example, the security document may contain between 5 and 20 of said elements.

In particular, said security elements are arranged in the form of a band and/or randomly distributed within said substrate.

The invention also relates to a security document or article obtained from said security sheet. The term "security element" is understood to mean any element with a security purpose, such as the security elements conventionally used in security documents (papers of value, such as banknotes, checks, coupons, restaurant tickets, etc.) but also those for other applications of security-protected papers associated with hygiene and/or medical matters and/or with traceability, with the safety of individuals, such as for example in order to indicate a specific event such as a date of expiry.

The term "security document" is understood to mean the usual documents such as banknotes, checks, tickets for entry to sporting or cultural events, titles of value, identity documents. It may also be a security article such as a package, a label or any other product comprising a sheet and having to be authenticated.

The invention also relates to a process for manufacturing said security elements, which is characterized in that:

- at least one portion of said authentication patterns is printed in one or more steps on one of the sides of its medium;
- at least one portion of said authentication patterns is printed, where appropriate on the other side, in one or more steps, either by being in register with respect to the shape of said element or by being in register with respect to the previously printed portion.

In addition, the printed medium is cut in registration into security elements of the desired shape and such that at least the in-register pattern is wholly present on said element.

Preferably, after the printing and before the cutting, the printed sheet or film may be covered, especially by printing means, with a heat-sealing lacquer in order to ensure retention in the substrate of the security document that will contain them.

A security document comprising a fibrous substrate that includes at least one security element as described above may be manufactured according to the following process:

- the fibrous substrate of the document is manufactured on a paper machine by introducing said security elements as obtained above;
- optionally, the surface of the substrate is treated in a size press, or by coating;
- the substrate obtained is dried;
- the substrate is cut into large sheets or is wound up as a continuous web;
- the cut sheets or the continuous web are printed in a manner appropriate to the use of the document; and
- the printed web or the sheet(s) are cut to the size of said document, optionally in registration with respect to said authentication means.

EXAMPLES

As a first example, the production of a security element according to the invention and a security paper containing it will be described below. A sheet of paper of the overlay type was manufactured using the conventional method of draining an aqueous suspension of cellulose fibers refined to a low degree, about 20° SR (degrees Schoepper-Riegler), and containing a wet-strength agent, this sheet being nonopacified and having a thickness of 70 μm. This sheet had a certain transparency.

The front side was printed in a fluorescent blue color and the reverse side in a fluorescent yellow color. An agent improving their wettability and a heat-sealing lacquer facilitating their retention in the paper were applied to the surface. The sheet obtained was cut into fibrettes, therefore of flat rectangular shape, having a width of about 1 mm and a length of about 1.5 mm. When these fibrettes were observed in transmitted light and under UV, they had a green color. These "three-color" fibrettes were dispersed in the paper pulp intended to manufacture a security paper. The sheet, optionally with other known security elements, was manufactured on a paper machine using the techniques known to those skilled in the art.

The resulting security paper included several fibrettes such as those described above, visible under UV light, having, when observed in transmitted light (under UV), on one side, a blue color and, on the other side, a yellow color, and when observed in transmitted light, and again under UV, a green color. Where this proved to be necessary, a slightly opacifying layer was applied before the blue printing so as to prevent the blue and yellow printing from interpenetrating in reflected light and producing the combinatorial color—green— which would be observed in transmitted light.

As a variant, it was possible, in another manufacturing run, to also produce single-color fibrettes having a fluorescent blue color on only one of these sides. Likewise, in another manufacturing run, it was possible to produce other fibrettes having a yellow fluorescent color on only one of these sides. A security paper can be produced having blue fluorescent fibrettes, yellow fluorescent fibrettes and "three-color" fibrettes.

As a second example, the production of another security element according to the invention and a security paper containing it will be described below. An opacified sheet of paper of the overlay type, having an opacity such that the patterns that it will bear would be visible without interference when observed in reflected (flat) light but allowing the patterns on the front and reverse sides to be observed in transmitted light, was manufactured. The front side was printed by heliography in a fluorescent yellow color. The reverse side was printed with patterns in the form of black dots about 0.2 mm in diameter. The dots were printed (distributed) according to the shape and size that the planchette would have after cutting. An agent improving their wettability and a heat-sealing lacquer facilitating their retention in the substrate which will contain them was applied to the surface. The sheet was cut into circular planchettes 1.5 mm in diameter in registration with the dots in order to obtain each planchette centered on a dot. As in the previous example, the circular planchettes were introduced into the paper pulp in order to manufacture a security paper containing them. When a planchette in the security paper was observed under UV and in reflection, fluorescent yellow planchettes and planchettes with the black spot centered on the planchette were seen. When the paper was observed under UV and in transmitted light, a yellow fluorescent planchette with a black spot centered on the planchette were seen. In transmitted light and without UV, the planchettes with the centered black spot were seen, strong light possibly being needed for this observation. Such planchettes are difficult to imitate by a counterfeiter as it is extremely difficult to print an in-register image and, in addition, one thus cut in registration.

The invention claimed is:

1. A flat security element, having a front side and a reverse side, and being relatively small in size, such as planchettes, wherein the element includes an in-register authentication pattern comprising at least one of (i) a combination and (ii) a superposition of a front side pattern on its front side and of a reverse side pattern on its reverse side, wherein each of said front side and reverse side patterns is at least partly observable in transmitted light, wherein said front side pattern is in the form of a front side geometric pattern and said reverse side pattern is in the form of a reverse side geometric pattern, wherein a registration of the in-register authentication pattern is characterized by at least one of (a) said in-register authentication pattern is in register with respect to at least one portion of the shape of said security element, and (b) at least one portion of said front side and reverse side patterns is in register with respect to at least one portion of the other of said front side and reverse side patterns, wherein the registration of said authentication pattern is observable in transmitted light from the front side and from the reverse side of the security element.

2. The security element as claimed in claim 1, wherein said front side pattern includes at least one given color and said reverse side patterns includes at least one other given color, said authentication pattern observed in transmitted light having a color resulting from the color on the reverse side and the color on the front side.

3. The security element as claimed in claim 2, wherein the colors on the front and reverse sides are chosen from primary colors.

4. The security element as claimed in claim 1, wherein each of said front side and reverse side patterns is selected from patterns in alphanumeric form, patterns in the form of a grid, patterns in the form of lines, patterns in the form of dots, and patterns formed of combinations thereof.

5. The security element as claimed in claim 1, wherein the dimensions of said element are between 0.5 and 6 mm.

6. The security element as claimed in claim 1, wherein each of the front side geometric shape and the reverse side geometric shape is selected from the group consisting of circular shapes, triangular shapes, oval shapes, square shapes, rectangular shapes, star shapes, moon shapes, and shapes with curved edges.

7. The security element as claimed in claim 1, wherein it includes printing in an amount of 1 to 10 g/m$^2$ per side, by dry weight.

8. The security element as claimed in claim 1, wherein each of said front side and reverse side patterns is chosen from patterns that are visible in natural light, patterns that are visible in UV light, patterns that are luminescent, patterns that are detectable by near infrared radiation, patterns that are detectable by medium infrared radiation, patterns that are thermochromic, patterns that are piezochromic, patterns that are based on DNA traces, patterns that are optically variable, patterns that are based on liquid crystals, patterns that are based on diffraction gratings, patterns that are based on moirépatterns, patterns that are based on holograms, patterns that are electromagnetic, and combinations thereof.

9. The security element as claimed in claim 8, wherein said element includes, beneath or alongside said front side and reverse side patterns, printing of magnetic character.

10. The security element as claimed in claim 8, wherein each of said front side and reverse side patterns is chosen from fluorescent patterns, phosphorescent patterns, and combinations thereof.

11. The security element as claimed in claim 1, wherein at least one of the front side and reverse side patterns is visible to the naked eye.

12. The security element as claimed in claim 1, wherein said element includes at least one of chemical authentication reactants, and reactants that reveal a specific event.

13. The security element as claimed in claim 1, wherein said security element has a medium which includes fibers.

14. The security element as claimed in claim 13, wherein said medium has at least one of a basis weight of from 25 to 40 g/m$^2$ and a thickness of from 50 to 110 μm.

15. The security element as claimed in claim 13, wherein said medium is a fibrous sheet based on at least one of natural and synthetic fibers.

16. The security element as claimed in claim 15, wherein said fibrous sheet is a paper based on cellulose fibers refined to a low degree, of the overlay type.

17. A security sheet comprising a fibrous substrate that includes several flat security elements as recited in claim 15.

18. The security element as claimed in claim 13, wherein the medium is a complex of a fibrous sheet and a plastic film.

19. The security element as claimed in claim 13, wherein said element is based on a bulk-opacified medium or on a medium having, on at least one of its sides, at least partly, a full or partial color, opacifying or barrier layer or printing.

20. A security sheet comprising a fibrous substrate that includes several flat security elements as recited in claim 13.

21. A security sheet comprising a fibrous substrate that includes several flat security elements as recited in claim 1.

22. The security sheet as claimed in the preceding claim 21, wherein said security elements are at least one of arranged in the form of a band and randomly distributed within said substrate.

23. A security document obtained from a sheet as claimed in claim 21.

24. A process for manufacturing security elements as claimed in claim 1, comprising the following steps:

printing front side patterns on a front side of a medium of the security elements;

printing a reverse side patterns on a reverse side of the medium of the security elements, so as to form in-register authentication patterns comprising at least one of (i) a combination and (ii) a superposition of the front side patterns on its front side and of the reverse side patterns on its reverse side, each of said front side and reverse side patterns being at least partly observable in transmitted light, wherein said front side patterns are in the form of front side geometric patterns and said reverse side patterns are in the form of a reverse side geometric patterns, wherein a registration of the in-register authentication patterns is characterized by at least one of (a) said in-register authentication pattern is in register with respect to at least one portion of a desired shape of said security element, and (b) at least one portion of said front side and reverse side patterns is in register with respect to at least one portion of the other of said front side and reverse side patterns, wherein the registration of said authentication patterns is observable in transmitted light from the front side and from the reverse side of the medium.

25. The manufacturing process as claimed in claim 24, wherein the printed medium is cut in registration into security elements of the desired shape and such that at least the in-register pattern is wholly present on said element.

26. The security element as claimed in claim 1, wherein the security element comprises a medium which is a plastic film.

27. The security element as claimed in claim 26, wherein the plastic film is a polyester film.

* * * * *